United States Patent [19]

Luthra

[11] Patent Number: 4,620,129

[45] Date of Patent: Oct. 28, 1986

[54] GETTERED HIGH PRESSURE SODIUM LAMP

[75] Inventor: Krishan L. Luthra, Schenectady, N.Y.

[73] Assignee: General Electric Company, Schenectady, N.Y.

[21] Appl. No.: 728,556

[22] Filed: Apr. 29, 1985

[51] Int. Cl.[4] ..... H01J 17/04

[52] U.S. Cl. ..... 313/630

[58] Field of Search ..... 313/630, 633

[56] References Cited

U.S. PATENT DOCUMENTS 3,708,710 1/1973 Smyser et al. ..... 313/630 X

*Primary Examiner*—Stewart J. Levy

*Assistant Examiner*—Joseph W. Roskos

*Attorney, Agent, or Firm*—Paul E. Rochford; James C. Davis, Jr.; Paul R. Webb, II

[57] ABSTRACT

High pressure sodium lamps have been subject to progressive reduction in pressure of contained sodium with attendant reduction in lighting quality. It has now been discovered that modification of lamp components permits the pressure of contained sodium to be maintained at higher levels. Emission materials enclosed within the lamp are altered to limit reactive oxygen in the lamp atmosphere. A thermionic electrode is equipped with an improved emission mix composition as illustrated in areas A and B of the triaxial plot of FIG. 3 and an oxygen getter is intermixed with the mix composition. The oxygen getter is a metal which forms a highly stable oxide and may be at least one selected from the group consisting of titanium, zirconium, hafnium, tantalum and yttrium.

7 Claims, 3 Drawing Figures

GETTERED HIGH PRESSURE SODIUM LAMP

CROSS REFERENCE TO RELATED APPLICATION

The Patent and Trademark Office may want to consider two copending applications in relaton to the subject application. One is Ser. No. 698,512 filed Feb. 4, 1985 and the other is Ser. No. 728,352 filed Apr. 29, 1985. Both are commonly assigned with the subject application. These applications are incorporated herein by reference.

BACKGROUND OF THE INVENTION

The present invention relates generally to high pressure sodium lamps having jackets of sintered polycrystalline aluminum oxide. More particularly, it relates to modification of lamp structure and components to overcome a problem of loss of sodium pressure within the lamp envelope, and particularly the loss of sodium, and the reduction of the pressure of sodium vapor necessary to the favorable operation of the lamp.

As used herein the term deluxe, as it is used in reference to high pressure sodium or HPS lamps, means a lamp having a pressure of sodium substantially higher than that of standard or conventional HPS lamps. For convenience of reference DHPS is employed as an alternative designation to the phrase deluxe high pressure sodium as used in connection with lamp structures. The term also designates a lamp which emits a light which is substantially white as contrasted with the light emitted from standard HPS lamps. The light emitted from standard HPS lamps is characteristically golden in coloration. The term HPS is used in the conventional sense to indicate high pressure sodium lamps which operate at lower pressure than DHPS lamps and which emit a characteristic golden light.

Components for lamps for the generation of light, which may involve the use of sodium and particularly sodium in high pressure, are disclosed in U.S. Pat. Nos. 4,285,732; 3,026,177; 3,485,343; 3,026,210; 3,935,495; 4,079,167; 4,150,317 and 3,788,710. The text of these patents, which are assigned to a common assignee herewith, are incorporated herein by reference.

As is explained in the above patents, sintered polycrystalline aluminum oxide is used as the jacket materials for discharge tubes of lamps. Such lamps may contain high pressure sodium (HPS) or the higher pressure sodium of deluxe (or DHPS lamps) in the discharge tubes. It is possible to obtain the desired partial pressure of sodium in these tubes by using an amalgam of sodium in mercury.

One of the major factors limiting the life of lamps employing the high pressure sodium discharges is the loss of sodium from the discharge. When the partial pressure of sodium within the discharge tube of the lamp is reduced, the light output of the lamp is affected. When the loss of sodium from the vapor phase in the lamp is large, the lamp may not even light when electric voltage is applied to the lamp in the conventional manner to induce operation.

Further it has been observed that a lamp, which initially has a suitably high pressure of sodium for deluxe HPS use or for HPS use, may gradually lose its pressure over a period of lamp use. Thus, although a DHPS lamp operates well initially, the useful life of the lamp may be so limited as to make sale and use of the lamp in commerce uneconomical or impractical. The standard HPS lamps have a less pleasant golden color. The efficiency of operation of HPS lamps as well as the life expectancy of such lamps is affected by the maintenance of a suitable high pressure of sodium in the lamps.

To be a color improved HPS lamp, so called deluxe lamp (DHPS lamp, the lamp should operate with higher pressure of sodium and this pressure is two to three times the pressure of sodium in a standard or conventional HPS lamp. One advantage of such deluxe lamps is that they emit a light which is whiter than that emitted from the lower pressure standard HPS lamps.

Standard HPS lamps have lives of the order of 20,000 hours. Longer operating lives are, of course, desirable.

It has been observed that within 3,000 to 10,000 hours of operation of deluxe HPS lamps (DHPS lamps), they may lose their color advantage and revert to the standard HPS lamps which emit the unpleasant golden color.

A number of studies have been made and are reported in the literature which have been concerned with the mechanisms by which sodium is lost from high pressure sodium lamps. The following are a number of reports which have been made on this general subject:

(A) A. Inouye, T. Higashi, T. Ishigani, S. Nagamo, and H. Shimojima, Journal of Light and Vis. Env. 3 (1979) 1.

(B) P. R. Prud'homme Van Reine, "Science of Ceramics", Proceedings of the Twelfth International Conference, June 27–30, 1983, Saint-Vincent, Italy, P. Vincenzini (Ed.), Ceramurgica, Italy, 1984, p. 741.

(C) E. F. Wyner, Journal of IES, 8 (1979) 166.

(D) H. Akutsu, Ph.D. dissertation, "Development of High Pressure Sodium Lamps", Matsushita Electronics Corp., Osaka, Japan, 1982.

(E) F. C. Lin and W. J. Knochel, Journal of IES, 3 (1974) 303.

(F) P. Hing, J. Illum. Eng. Soc. 10 (1981) 194.

In the first article, identified as A above, the suggested mechanism for the reduction in the pressure of sodium vapor is one by which leakage occurs through the seal glass. According to references C and E involved, the suggested mechanism for the loss of the sodium of the high pressure sodium vapor is by electrolysis through the tube wall.

The mechanism suggested in the references of D and F is one according to which a reaction occurs with the tube wall and diffusion occurs through the wall. Many investigators believe that the sodium loss occurs by this latter mechanism.

These latter references also suggest that sodium present in the arc tubes reacts with the alumina of the enclosing tube to form beta alumina having formula $Na_2O.11\ Al_2O_3$ and/or sodium aluminate having the formula $NaAlO_2$.

BRIEF SUMMARY OF THE INVENTION

It is accordingly one object of the present invention to provide a high pressure sodium lamp article which is not as subject to loss of the high pressure of sodium vapor as prior art lamps.

Another object is to provide a means by which the high pressure of sodium vapor in an HPS lamp may be retained for an extended period.

Another object is to provide a method of improving the retention of sodium vapor in lamps at high pressure.

Another object is to provide means by which the retention of sodium vapor of deluxe higher pressure sodium lamps may be improved so that they emit a whiter light for a longer time.

Another object is to enhance the operation of high pressure sodium lamps by reducing the tendency of HPS lamps, both deluxe and standard, to loss of pressure of sodium vapor.

Other objects will be in part apparent and in part pointed out in the description which follows.

In one of its broader aspects objects of the invention can be achieved by providing a high pressure sodium vapor lamp having an emission material of a composition selected from the areas designated A and B of the accompanying graph of FIG. 3.

A small amount of at least one finely divided metal oxygen getter is admixed with the emission mix. The amount of finely divided oxygen getter metal is less than that which can cause reduction of oxides of the emission mix. Oxygen getters suitable for use in connection with the present invention include at least one metal selected from the group consisting of titanium, zirconium, tantalum, hafnium and yttrium.

BRIEF DESCRIPTION OF THE DRAWINGS

The description of the invention which follows will be aided by reference to the accompanying drawings in which.

DESCRIPTION OF THE PREFERRED EMBODIMENTS

Figure 1:
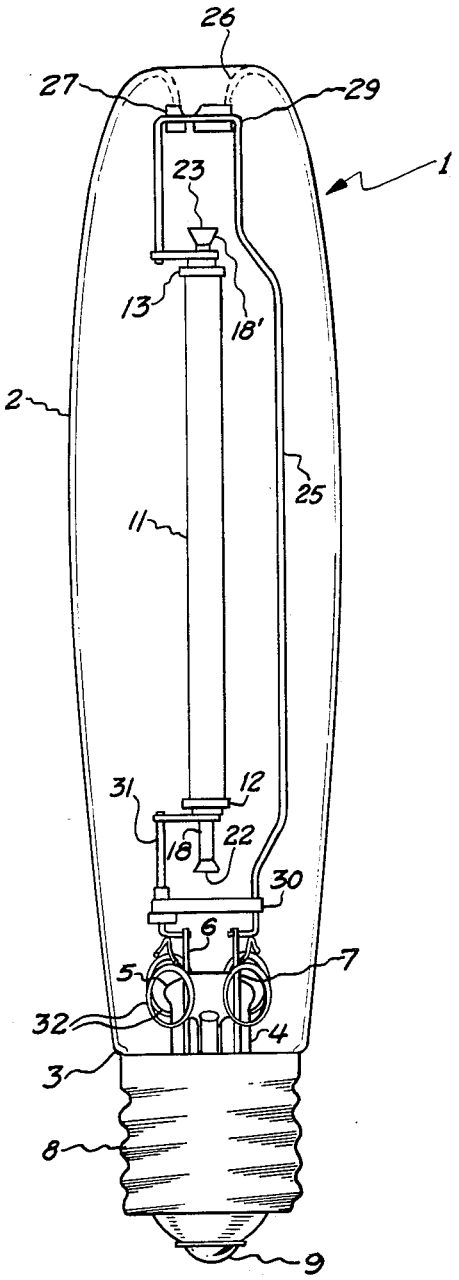
FIG. 1 is a schematic view of a jacketed high pressure sodium vapor lamp embodying the improved emission material of the present invention.

A high intensity sodium vapor discharge lamp in which the invention of the subject application may be embodied, is illustrated at 1 in FIG. 1 and comprises an outer vitreous envelope or jacket 2 of elongated ovoid shape. The neck 3 of the jacket is closed by a reentrance stem 4 having a press seal 5 through which extends stiff in-lead wires 6 and 7 which are connected at their outer ends to the threaded shell 8 and center contact 9 of a conventional screw base. The inner envelope or arc tube 11 is made with sintered high density polycrystalline alumina material to provide increased in-line optical transmission. The ends of the tube are closed by thimble-like niobium metal end caps 12 and 13 which have been hermetically sealed to the improved alumina arc tube by means of a glass sealing composition which is shown, although exaggerated in thickness, at 14 in FIG. 2.

Figure 2:
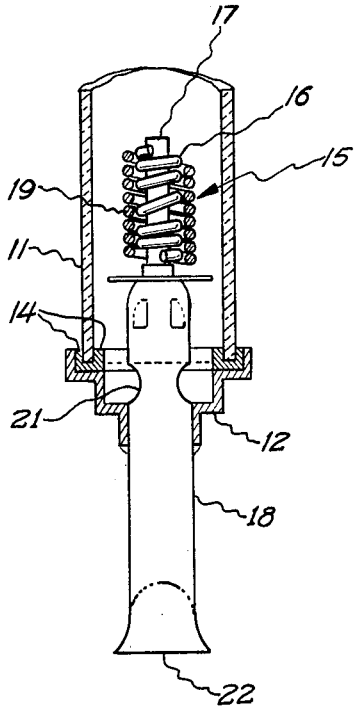
FIG. 2 is a sectional view of an electrode configuration for the lamp depicted in FIG. 1.

Thermionic electrodes 15 are mounted on the ends of the arc tube. As best seen in FIG. 2, the electrode comprises an inner tungsten wire coil 16 which is wound over tungsten shank 17 crimped or welded in the end of a niobium tube 18 which is in turn welded to the end cap 12. The central turns of the inner coil 16 are spread apart and the outer tungsten wire coil 19 is screwed over the inner coil.

Heretofore a suitable electron emissive mix, such as that described in U.S. Pat. No. 3,708,710, has been applied to the electrode coils by painting or alternatively by dipping the coils in the emissive mix suspension. The material is retained primarily in the interstices between the turns of outer and inner coil and of inner coil and shank.

The present invention provides an improved composition for use in connection with the emitter function of high pressure sodium vapor lamps.

Continuing now with the description of a typical high pressure sodium vapor lamp, a lower tube 18 is pierced through at 21 and is used as an exhaust tube during manufacture of said lamp. After the gas filling sodium mercury amalgam has been introduced into the arc tube, exhaust tube 18 is hermetically pinched off by a cold weld indicated at 22 and serves thereafter as a reservoir for condensed sodium mercury amalgam. Upper tube 18 has a construction similar to that of tube 18 but it has no opening in the arc tube and is used to contain a small amount of yttrium metal (not shown) which serves as a getter. The end of the tube is closed by a pinch 23 which forms a hermetic seal. One way in which a getter contained within a sealed niobium tube within a lamp operates to getter oxygen from the lamp is described in U.S. Pat. No. 3,485,343 of Jorgensen. As stated in the patent: "The niobium end cap structures are permeable to oxygen at lamp temperature operating conditions so that any oxygen present in either the interior of the arc tube or in the inter-envelope space may diffuse through the niobium and react with the contained reactant". The patent also teaches an improved reactant. This patent is incorporated herein by reference.

The illustrated lamp is limited to a base-down operation wherein the longer exhaust tube 18, which must be the coolest portion of the arc tube for the amalgam to condense therein, is located lowermost.

The arc tube is supported within the outer envelope by means of a mount comprising a single rod 25 which extends the length of the envelope from in-lead 7 at the stem end to a dimple 26 at the dome end to which it is anchored by a resilient clamp 27. End cap 13 of the improved arc tube is connected to the frame by band 29 while end cap 12 is connected to in-lead 6 through band 30 and support rod 31.

The inter-envelope space is desirably evacuated in order to conserve heat. The evacuation is done prior to sealing off the outer jacket. A second and separate getter, suitably barium-aluminum alloy powder pressed into channeled rings 32, is flashed after sealing in order to insure a high vacuum. A method of manufacturing this type lamp construction is further disclosed in U.S. Pat. No. 3,708,710, which is also incorporated by reference and hence need not be repeated in connection with the present invention.

The U.S. Pat. No. 3,708,710 teaches the combination of a high pressure, HPS, sodium vapor lamp in which an electron emission material is incorporated. The composition of the material is included within the area designated A on the accompanying triaxial plot included in the drawings as FIG. 3.

In the U.S. Pat. No. 3,708,710, it is pointed out that the electrodes of the lamp are required to provide copious electron emission and to be resistant to vaporization and ion bombardment, but that these properties do not in general go together.

The object of that patent was to provide a cathode with electron emissive material which is a good emitter and at the same time more resistant to vaporization and ion bombardment when used in a deluxe high pressure sodium vapor lamp (DHPS) than materials available heretofore. In this the patentees succeeded.

They did so by the discovery that "dibarium calcium tungstate, $Ba_2CaWO_6$, is a better electron-emitting material for use in high intensity discharge lamps and particularly high pressure sodium vapor lamps than any material up to now", see column 1, line 56.

The dibarium calcium tungstate employed in the U.S. Pat. No. 3,708,710 is single phase and is prepared by a variety of well-known techniques as is pointed out in the patent. One technique involves ball milling of the starting constituents, namely $BaCO_3$, $CaCO_3$ and $WO_{2.97}$ and then firing in air at 1700° C. for four hours and then cooling to room temperature. X-ray powder diffraction showed the reaction to the $Ba_2CaWO_6$ to be complete and that only the compound $Ba_2CaWO_6$ to be observed.

Formation of the same composition in situ in the lamp is also disclosed.

The U.S. Pat. No. 3,708,710 also discloses that "the $Ba_2CaWO_6$ phase is that desired but emission material which consists of a $Ba_2CaWO_6$ solid solution phase or a solid solution phase together with small amounts of binary phases are also satisfactory", see column 3, line 15.

It is also pointed out in the U.S. Pat. No. 3,708,710 that compositions having a mole fraction of CaO greater than 0.30 are not desirable due to insufficient electron emission; that compositions richer in BaO than claimed have an evaporation rate many times higher than $Ba_2CaWO_6$; and that any initial advantage of these BaO containing compositions containing a high percent of BaO, due to higher electron emission, is rapidly dissipated. It is rapidly dissipated because of the higher evaporation rate of a physical mixture having constituents outside the range of solid solubility.

What was not recognized at the time of the invention of the U.S. Pat. No. 3,708,710, and what has not been evidently recognized to this date, is that an oxide emission mix can cause sodium loss by chemical reactions involving chemically bound oxygen released from an emission mix. In particular the mix provides chemically bound oxygen. As an example, the following reaction yields solid tungsten metal and gaseous oxygen:

$$\underline{WO_3}(s) = W(s) + 3\underline{O}(g) \quad (1)$$

Gaseous oxygen may be released by such a reaction or the released oxygen may combine with other reactants. Here, the underline indicates that $WO_3$ is not present as a single oxide but exists at less than unit chemical activity in combination with other oxides. Other reactions involving only the gaseous products of reaction are also possible.

By activity of an element or a compound is meant the chemical activity of the element or compound in its indicated chemical environment. As is well-known, the chemical activity of an element such as tungsten ($a_W$) in an environment containing $WO_3$ at a given temperature is stated by the following expression:

$$a_W = \frac{p_W}{p_W^o}$$

where $p_W$ = the partial pressure of tungsten in the stated environment, and $p_W^o$ = the partial pressure of tungsten in an environment containing pure solid tungsten.

In the environment of the HPS or DHPS lamp such released oxygen in turn reacts with sodium vapor. The oxygen gas and sodium vapor also react with $Al_2O_3$ from arc tube 11 or seal glass of tube 11 to tie up sodium as sodium $\beta$-alumina or sodium aluminate by one or both of the following reactions:

$$2Na(g) + O(g) + 11Al_2O_3(s) = Na_2O11Al_2O_3(s) \quad (2)$$

$$2Na(g) + O(g) + Al_2O_3(s) = 2NaAlO_2(s) \quad (3)$$

The oxygen also forms sodium tungstate with the mix.

According to the present invention sodium loss is reduced by reducing the release of oxygen and the consequent oxygen pressure within the arc tube 11. Two ways of accomplishing such reduction are described in the copending applications cross-referenced above. In one such application, I change the composition of the oxide mixture to that in area B of FIG. 3. In the other, I admix tungsten metal with an emission mix having a tungsten oxide base.

Pursuant to the present invention I accomplish a reduction of oxygen gas in the lamp atmosphere by adding a small quantity of an oxygen getter powder to the emission mix to the extent of a maximum of 30 percent by weight.

The minimum amount of getter would depend on its particle size and the amount of oxygen impurities present within the lamp. The maximum amount of getter to be added to the emission mix is an amount less than that which causes decomposition of the emission mix. Such an amount can be easily determined experimentally for each getter and next by a few scoping experiments.

Figure 3:
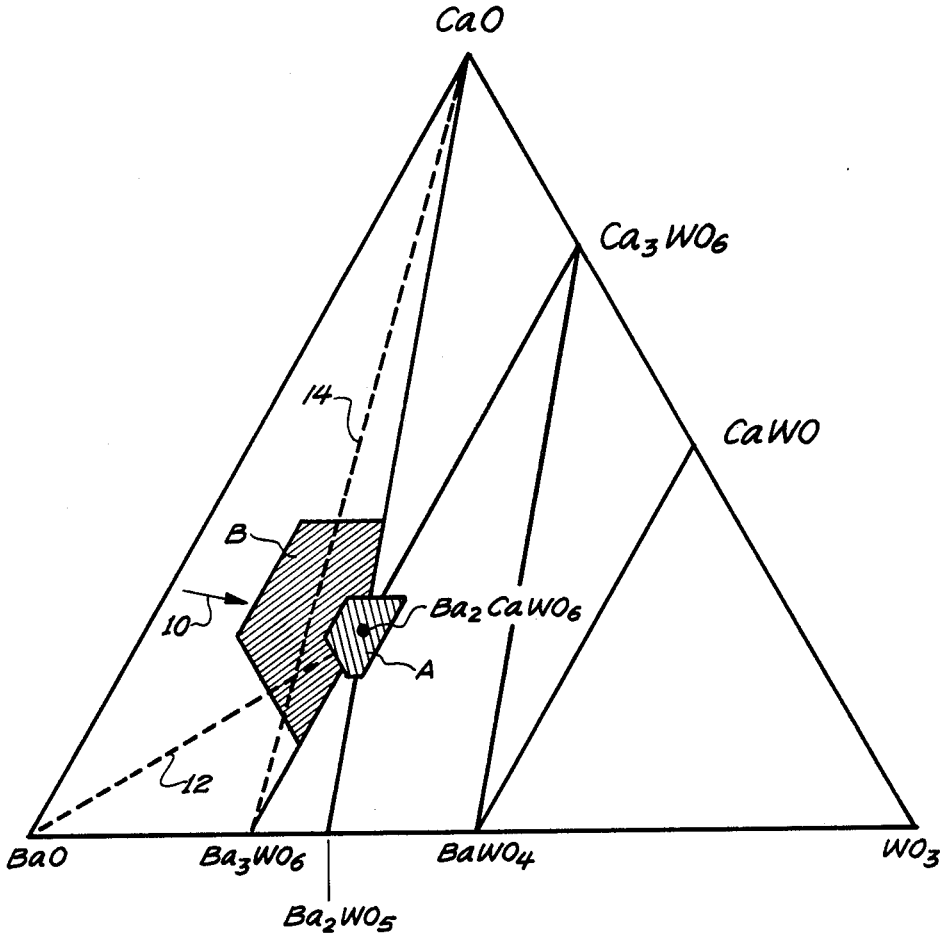
FIG. 3 is a triaxial graph of a ternary compositions suitable for use in connection with the present invention.

An oxide emission mix with which the getter of the present invention is useful is an oxide mix as illustrated in FIG. 3, particularly one having a composition illustrated in the shaded areas A and B of FIG. 3. Regarding these mix compositions there is some description in the copending applications cross referenced above.

The decomposition of the emission mixture to action of the getter should not be confused with changes which occur in the mix at the operating temperature of the lamp.

As is explained in copending application Ser. No. 698,512, in accordance with lamp operation, there is some loss of BaO and CaO by volatilization. However this same loss occurs for all emission materials containing these oxides. I have recognized that the composition of emission material changes in the direction indicated by arrow 10 of FIG. 3. The arrow points in the direction in which the composition of the triaxial plot will move due to increased $WO_3$ chemical activity. If, for example, one starts with single phase $Ba_2CaWO_6$, the composition changes in the direction indicated by the arrow to make a three phase mixture of $Ba_2CaWO_6$, $BaWO_4$, and $Ca_3WO_6$.

The emission mix claimed in this application is one which contains an oxygen getter and the oxide emission mix, the composition of which is indicated in FIG. 3 as the areas enclosed within the shaped areas A and B, and preferably that enclosed within shaped area A.

The present invention contemplates a reduction in the oxygen generated by introduction into the emission mix of powdered metal getters selected from the group consisting of titanium, zirconium, hafnium, tantalum and yttrium in quantities small enough to avoid any decomposition of the mix.

The emission materials proposed in this invention can be made by a variety of techniques well known in the chemical or ceramic art. The oxide mixtures can first be made by any of the techniques suggested in the U.S.

Pat. No. 3,708,710, such as a ball milling and firing technique discussed above. To this mixture, a suitable amount of finely divided metal powder of the desired composition can be blended.

What is claimed and sought to be protected by Letters Patent of the United States is as follows:

1. As an emission mix for a HPS or DHPS sodium vapor lamp, the composition corresponding to points within the shaped areas A and B of the triaxial plot of FIG. 3 multiphase compositions derived from CaO, BaO and $WO_3$, said composition containing a small percentage of an oxygen getter metal which is solid at the operating temperature, above 1200° C., of the emission material of the sodium vapor lamp.

2. The emission mix of claim 1 in which the points are within shaped area A.

3. A thermionic electrode for a HPS or DHPS sodium vapor lamp comprising a tungsten wire having deposited thereon a composition corresponding to points within the shaped areas A and B of the triaxial plot of FIG. 3 of compositions of CaO, BaO and $WO_3$, said composition containing a small percentage of a metal effective as an oxygen getter at an operating temperature, above 1200° C., of the thermionic electrode.

4. The electrode of claim 3 in which the points are within shaped area A.

5. A high intensity high pressure sodium electric discharge lamp comprising a light-transmission envelope having electrodes sealed into its ends and containing an ionizable medium for carrying the discharge, said electrodes consisting of a refractory metal support structure and an electron emissive component applied thereto consisting of a composition corresponding to points within the shaped areas A and B of the triaxial plot of FIG. 3 of multiphase compositions derived from CaO, BaO and $WO_3$, said composition containing a small percentage of a metal effective as an oxygen getter which remains solid at an operating temperature, above 1200° C., of the electrodes of said lamp.

6. A high intensity high pressure sodium electric discharge lamp comprising a light-transmissive envelope having electrodes sealed into its ends and containing a ionizable medium for carrying the discharge, said electrodes consisting of a refractory metal support structure and an electron emissive compound applied thereto consisting of a composition corresponding to points within the shaped area A of the triaxial plot of FIG. 3 of multiphase compositions derived from CaO, BaO and $WO_3$, and said compound containing a small amount of a finely divided metal effective at the operating temperature of the electrodes of said lamp as an oxygen getter.

7. A method for forming an electrode for a HPS or DHPS lamp having extended useful life which comprises providing an electrode of refractory metal, preparing an emission mix of oxides to contain an oxygen getter in an amount less than that which causes decomposition of said mix, and depositing said emission mix on said refractory metal electrode.

* * * * *